US008528211B2

(12) United States Patent
Hall

(10) Patent No.: US 8,528,211 B2
(45) Date of Patent: Sep. 10, 2013

(54) METHOD OF ATTACHING A CABINET ASSEMBLY TO A HOT TUB

(75) Inventor: Keith A. Hall, Bettendorf, IA (US)

(73) Assignee: Quad Cities Automatic Pools, Inc., Bettendorf, IA (US)

( * ) Notice: Subject to any disclaimer, the term of this patent is extended or adjusted under 35 U.S.C. 154(b) by 341 days.

(21) Appl. No.: 12/957,654

(22) Filed: Dec. 1, 2010

(65) Prior Publication Data

US 2012/0137489 A1 Jun. 7, 2012

(51) Int. Cl.
*B21D 47/00* (2006.01)

(52) U.S. Cl.
USPC ..... 29/897.31; 29/897.32; 29/453; 4/506

(58) Field of Classification Search
USPC ..... 29/897.31, 897.312, 897.32, 453, 29/451; 4/506, 549, 555–558, 584, 592
See application file for complete search history.

(56) References Cited

U.S. PATENT DOCUMENTS

| | | | | |
|---|---|---|---|---|
| 2,056,024 | A * | 9/1936 | Stuart | 52/204.597 |
| 3,298,038 | A * | 1/1967 | O'Connell et al. | 52/300 |
| 3,877,085 | A * | 4/1975 | Bukaitz et al. | 52/169.7 |
| 2004/0103472 | A1* | 6/2004 | Marbach et al. | 4/506 |
| 2005/0132487 | A1* | 6/2005 | Layfield et al. | 4/541.1 |
| 2009/0165201 | A1* | 7/2009 | Vultaggio | 4/506 |
| 2009/0172873 | A1* | 7/2009 | Ludlow et al. | 4/506 |
| 2009/0211011 | A1* | 8/2009 | Walker et al. | 4/506 |
| 2010/0031434 | A1* | 2/2010 | Tassone et al. | 4/506 |
| 2011/0000013 | A1* | 1/2011 | Elnar | 4/584 |

* cited by examiner

*Primary Examiner* — David Bryant
*Assistant Examiner* — Justin Sikorski
(74) *Attorney, Agent, or Firm* — Zarley Law Firm, P.L.C.

(57) ABSTRACT

A method of attaching a cabinet assembly to a spa. The method includes providing a frame that has a channel that forms a perimeter. A spa is placed on the frame such that a flange or lip of the spa extends past the perimeter created by the channel. A plurality of slats are then secured between the flange of the spa and the channel of the frame in order to form a cabinet around the spa.

7 Claims, 4 Drawing Sheets

METHOD OF ATTACHING A CABINET ASSEMBLY TO A HOT TUB

BACKGROUND OF THE INVENTION

This invention relates to an assembly of a spa or hot tub. More specifically, this invention relates to attaching the cabinet assembly around and to a hot tub.

Spas have been used for leisure activities for many years. Specifically, a large tub is presented that holds heated water and typically contains a plurality of jets to whirl water around the tub as desired. Typically, a spa is held up by a frame that is not aesthetically pleasing to a casual observer. As a result, a cabinet assembly is placed around the frame to provide a more aesthetically pleasing look.

This cabinet assembly is made by building a wooden frame and then securing to that frame a plurality of rigid individually manufactured panels utilizing fastening members such as screws. Then, if this cabinet assembly is built separate from the spa, the spa still needs to be either placed within the cabinet assembly or the cabinet assembly placed around the spa.

While this wood frame used in combination with the manufactured rigid panels covers up the spa frame thus providing an aesthetically pleasing look, problems still remain. Specifically, building the wood frame is not only time consuming but additionally the individually manufactured pieces can be very costly. In addition, the wood frame provides minimal insulation for the hot tub or spa itself wherein often the water within the spa is desired to be at an elevated temperature. Thus, inefficiencies of the spa occur.

Therefore, a principal object of the present invention is to provide a method of attaching a cabinet assembly to a spa that is both efficient and cost effective.

These and other objects, features or advantages will become apparent from the specification and claims.

BRIEF SUMMARY OF THE INVENTION

A method of attaching a cabinet assembly to a spa. The steps include providing a frame that has a plurality of channels that form a perimeter that is of size and shape to receive a spa. This spa is then placed onto the frame such that a flange or lip extends from the spa past the perimeter of the frame such that the flange is positioned in parallel spaced relation to at least one of the plurality of channels. Once the spa is in place, insulating panels are inserted between the flange of the spa and the plurality of channels of the frame. A plurality of flexible slats are then secured between the flange of the spa and the channel to form a cabinet around the spa thus covering the frame and insulating panels of the spa.

DETAILED DESCRIPTION OF THE PREFERRED EMBODIMENT

Figure 1:
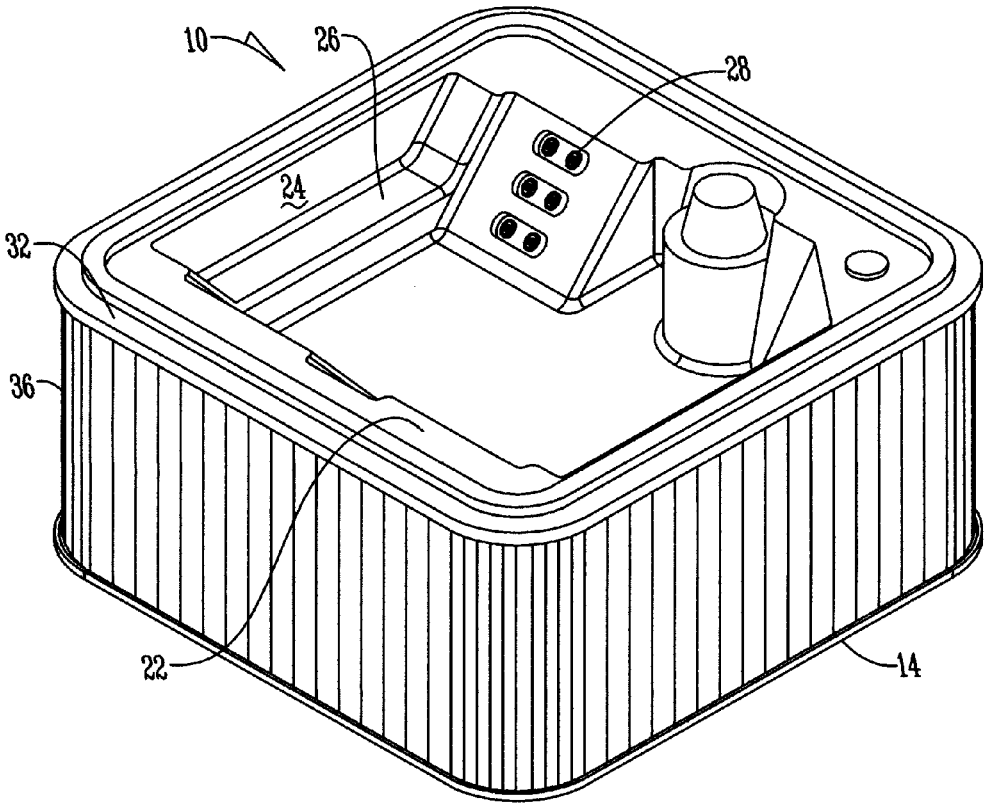
FIG. 1 is a perspective view of a cabinet assembly.
Figure 2:
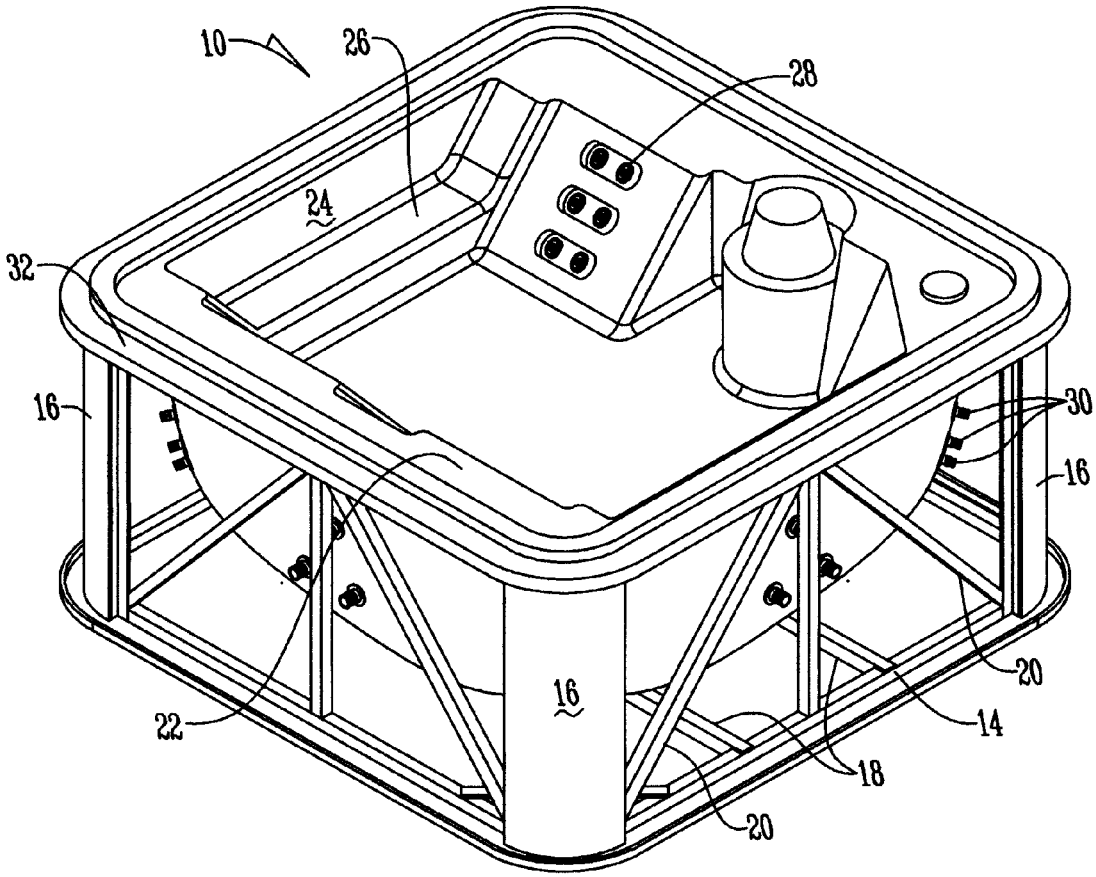
FIG. 2 is a perspective view of a spa within a frame of a cabinet assembly.

The figures show a cabinet assembly 10 that includes a frame 12. The frame 12 has channel 14 that is secured to a plurality of posts 16 in order to form a perimeter that is of size and shape to accommodate a spa or a hot tub. The posts can be of single piece construction or have three corner brace sections. The three brace embodiment allows the corners to be universal regardless of length. In a preferred embodiment, the channel 14 is a U-shaped channel; however, an L-shaped channel or the like could be used without falling outside the scope of this disclosure. Extending between individual channels 14 are a plurality of horizontal brace members 18 that provide additional structural support to the frame 12. Similarly, a plurality of brace members 20 are secured to the channel 14 and extend diagonally and vertically to form a king post truss to provide additional support and strength.

Placed on top of the vertical brace members 20 and post 16 of the frame 12 is a spa or a hot tub 22. The spa or hot tub 22 is of any kind known in the art and typically has a fiberglass body 24 that forms a cavity 26 that receives water and additionally has a plurality of openings 28 disposed therein for receiving nozzles 30 and the like. Also, as known in the art, the spa 22 has a flange or lip 32 at its top outer perimeter. In order to form the cabinet assembly 10 of the present invention the spa 22 is placed on the frame 12 such that the flange 32 extends past the frame 12 and is positioned in parallel spaced relation from the channel 14. In a preferred embodiment the frame 12 is a galvanized powder-coated steel frame.

Figure 3:
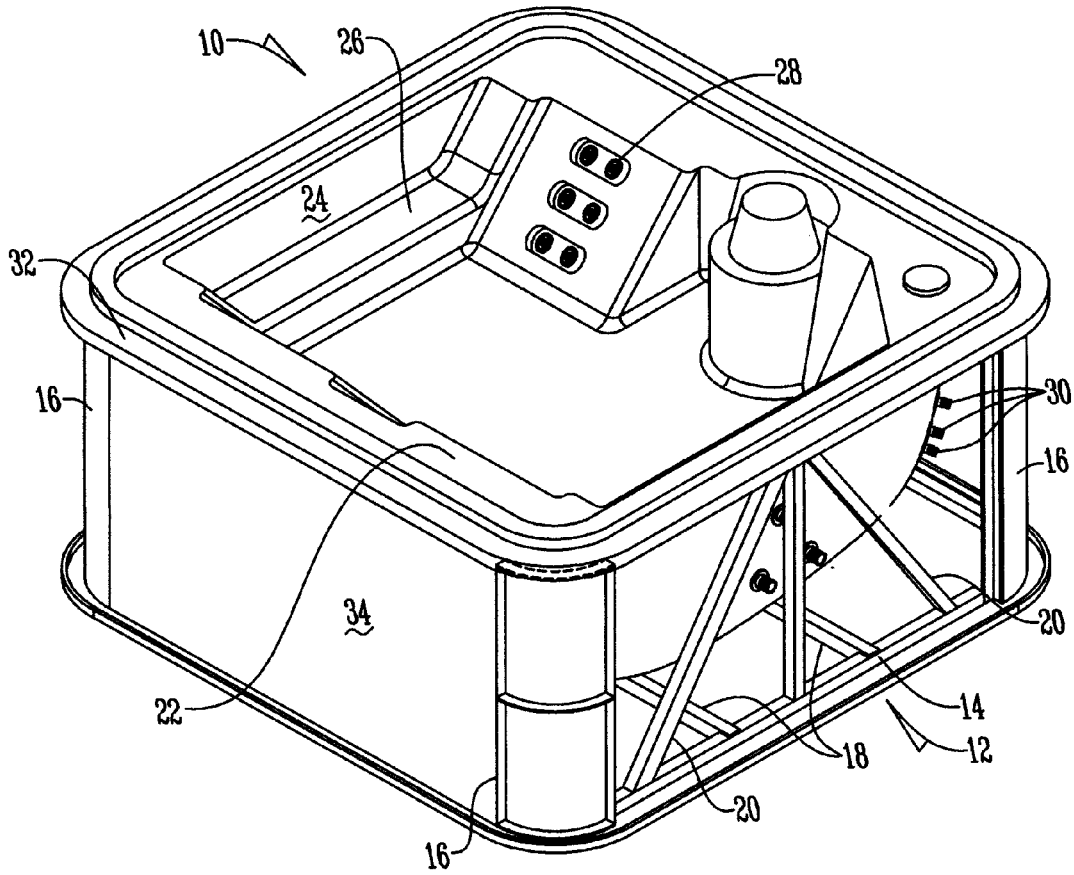
FIG. 3 is a perspective view of a spa within a frame that contains an insulating panel of a cabinet assembly.
Figure 4:
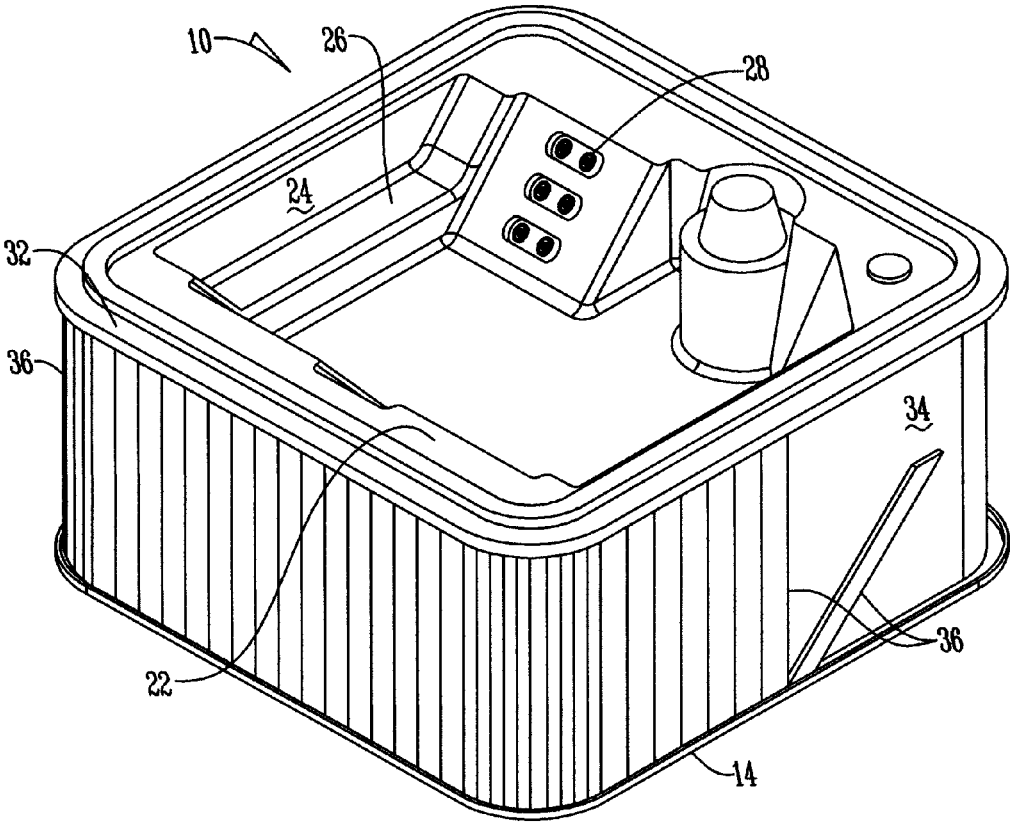
FIG. 4 shows a perspective view of a plurality of slats that have been secured to the frame and spa of a cabinet assembly.

FIG. 3 shows insulating panels 34 that are placed between an individual channel 14 and the flange 32 of the spa 22 such that the insulating panel 34 is secured therebetween. Individual panels can be placed within any side of the frame to provide additional insulation for the spa 22.

After a plurality of insulating panels 34 are in place around the spa 22 a plurality of slats 36 are placed between the individual channels 14 and the flange 32 of the spa 22. Preferably the plurality of slats 36 are made of an elastic material such as plastic such that the plurality of slats 36 can individually be snapped into place between the channel 14 and the flange 32 of the spa 22. When securing the plurality of slats 36 between the flange 32 of the spa 22 and channel 14 to form a cabinet around the spa 22, the flange 32, spa 22 and the channel 14 place tension on the plurality of slats 36 in order to secure the plurality of slats 36 in place.

In operation, in order to attach the cabinet assembly 10 to the spa 22, the frame 12 having the channel 14 that form a perimeter is provided. Next, the spa 22 is placed onto the frame 12 such that a flange 32 extends from the spa 22 to past the perimeter of the frame 12 so that the flange is positioned in parallel spaced relation to the channel 14. The insulating panels 34 are then inserted within and in between the flange 32 of the spa 22 and the channel 14. Once the insulating panels 34 are in place, a plurality of slats 36 are secured between the flange 32 of the spa 22 and channel 14 to form a cabinet around the spa 22.

By utilizing the cabinet assembly 10 there is no longer a need for a wood frame and panelized system to produce a cabinet assembly. Instead, by using the cabinet assembly 10 an insulated metal frame can be quickly and easily assembled by snapping in the plurality of slats 36. Thus, assembly time is reduced as the individual assembling the cabinet no longer has to use fastening materials such as screws to secure together a wooden frame. In addition, by using the plastic slats for the cabinet assembly, cost is greatly reduced. Thus, not only does the cabinet assembly reduce costs but additionally the assembly saves time during installation. In addition, the insulating panel provides an extra layer of insulation and thus at the very least all of the stated objectives have been met.

It will be appreciated by those skilled in the art that other various modifications could be made to the device without departing from the spirit and scope of this invention. All such modifications and changes fall within the scope of the claims and are intended to be covered thereby.

What is claimed is:

1. A method of attaching a cabinet assembly to a spa the method comprising:

providing a frame having a channel adjacent a bottom end;

placing a spa onto the frame such that a flange extending from the spa is positioned in a parallel spaced relation to the channel adjacent a top end; and securing a plurality of slats between the flange of the spa and the channel to form a cabinet around the spa;

wherein each of the slats have a bottom end positioned in the channel and a top end positioned adjacent the flange such that flange and the channel place tension on the slats.

2. The method of claim 1 further comprising the step of inserting at least one insulating panel between the flange of the spa and the channel before securing the plurality of slats between the flange of the spa and the channel.

3. The method of claim 1 wherein the frame comprises four post members placed in spaced relation such that the channel extends between and is secured to the post members.

4. The method of claim 1 wherein the plurality of slats are secured between the flange of the spa and the channel by snapping the plurality of slats in place such that the flange of the spa and the channel place tension on the plurality of slats.

5. The method of claim 1 wherein a fastening element is not used to secure the plurality of slats between the flange of the spa and the channel.

6. The method of claim 1 wherein the channel is U-shaped.

7. The method of claim 1 wherein the plurality of slats are elastic allowing the slats to be bent when securing the plurality of slats between the flange of the spa and the channel.

* * * * *